US007226071B2

(12) United States Patent
Garcin et al.

(10) Patent No.: US 7,226,071 B2
(45) Date of Patent: Jun. 5, 2007

(54) RUNNING SURFACE FOR A WINTER SPORTS APPARATUS

(75) Inventors: Pierre Garcin, Saint Ours (FR); Urs Geissbühler, Thun (CH); Aude Cebocli, Sonnaz (FR)

(73) Assignee: IMS Kunststoff AG, Worb (CH)

( * ) Notice: Subject to any disclaimer, the term of this patent is extended or adjusted under 35 U.S.C. 154(b) by 438 days.

(21) Appl. No.: 10/983,891

(22) Filed: Nov. 9, 2004

(65) Prior Publication Data

US 2006/0097485 A1 May 11, 2006

(51) Int. Cl.
*A63C 5/00* (2006.01)

(52) U.S. Cl. ..... 280/610; 508/100

(58) Field of Classification Search ..... 280/610, 280/609, 601, 600; 508/100, 112, 450, 451, 508/548, 590

See application file for complete search history.

(56) References Cited

U.S. PATENT DOCUMENTS 4,126,481 A * 11/1978 Sampson et al. ..... 508/100
4,724,093 A * 2/1988 Gambaretto ..... 508/590
5,114,482 A * 5/1992 Hertel ..... 106/270
5,131,674 A * 7/1992 Tokui et al. ..... 280/610
5,202,041 A * 4/1993 Traverso et al. ..... 508/590
5,272,199 A * 12/1993 Geissbuhler ..... 524/439
5,409,622 A * 4/1995 Chapman et al. ..... 508/137
5,423,994 A * 6/1995 Traverso et al. ..... 508/590
5,466,743 A * 11/1995 Schamesberger ..... 524/462
5,547,594 A * 8/1996 Karydas ..... 508/112
5,571,779 A * 11/1996 Kleiner et al. ..... 508/153
5,624,713 A * 4/1997 Ramer ..... 427/371
5,914,298 A * 6/1999 Karydas ..... 508/106
6,063,739 A * 5/2000 Geissbuhler ..... 508/106
6,121,212 A * 9/2000 Gambaretto ..... 508/590
6,465,398 B1 * 10/2002 Arnold ..... 508/181

FOREIGN PATENT DOCUMENTS

CH 657 993 A5 10/1986
CH 660 018 A5 3/1987

* cited by examiner

*Primary Examiner*—J. Allen Shriver
(74) *Attorney, Agent, or Firm*—Shoemaker and Mattare

(57) ABSTRACT

The gliding properties of running surfaces for winter sports apparatus, e.g. skis and snowboards are improved by a mineral addition chosen from the sodalite group and tsaregorodtsevite-wadalite series or a mixture thereof. An ultramarine is especially preferred as the mineral additive. Gliding properties are similar to or improved in comparison to those obtainable with the addition of soot, carbon black or graphite. The mineral addition according to the invention can however be combined with the addition of soot, carbon black or graphite. The invention also opens up new possibilities in the coloration of running surfaces.

17 Claims, No Drawings

RUNNING SURFACE FOR A WINTER SPORTS APPARATUS

BACKGROUND OF THE INVENTION

The invention relates to a running surface for a winter sports apparatus, more precisely to the enhancement of the gliding properties of such a running surface.

Currently used running surfaces for winter sports apparatus, e.g. any types of skis (e.g. cross-country skis, alpine skis, telemark skis), snowboards, skiboards, sleds etc., in more general terms for any running surface intended for gliding on snow or ice are preferably made of hydrophobic plastics, e.g. polyethylene (PE). The mechanism of gliding of such running surfaces on snow and/or ice is yet not fully understood. However, it is believed that upon interaction of surface roughness and snow- or ice crystals a hydrodynamic lubricating effect upon melt water due to frictional heat is essentially involved.

At higher gliding speed, the locally formed melt water tends to spread all over the running surface, leading to an unwanted "suction effect" which may influence the gliding speed in a negative way. In order to overcome this phenomenon, additives such as soot, carbon black and graphite have been added to the polyethylene matrix (see e.g. CH 657 993 A and CH 660 018 A). These additives are supposed to diminish the "suction effect" due to their higher heat conductivity. The superior gliding properties of such modified running surfaces led to their preferential use today. However, these running surfaces are inevitably black due to the black color of soot, carbon black and graphite, thus hampering any alternative coloration of running surfaces. Moreover, there is a high need for further improved gliding properties of running surfaces, especially for sports competition purposes.

SUMMARY OF THE INVENTION

It is an object of the present invention to avoid the shortcomings of the known running surfaces and particularly to provide a running surface for winter sports apparatus with further improved gliding properties. It is an additional object of the invention, to provide a running surface for winter sports apparatus that allow for a non-black coloration. Such running surfaces need to be inexpensively and easy to produce and to apply. Moreover, the running surfaces have to meet the demands of high durability.

The above-mentioned objects are fulfilled by a running surface for a winter sports apparatus, a winter sports apparatus comprising such a running surface, a material composition for the production of such running surface and a method of manufacture such running surfaces according to the independent claims.

The invention concerns a running surface for a winter sports apparatus or the like, e.g. any types of skis (e.g. cross-country skis, alpine skis, telemark skis), snowboards, skiboards, sleds etc., in more general terms any types of running surfaces intended for gliding on snow or ice wherein the running surface contains a mineral addition chosen from the sodalite group and tsaregorodtsevite-wadalite series or a mixture thereof. Explicitly enclosed within the intention of the invention are also naturally and non-naturally occuring closely related structural and/or chemical analogues of these minerals, especially the derivatives obtainable by exchange of the cation(s) or anion(s). The nomenclature of these mineral additions is given according to the Strunz Classification System [Hugo Strunz; Ernest Nickel: Strunz Mineralogical Tables. Ninth Edition. 2001. ISBN 3-510-65188-X], where the sodalite group and tsaregorodtsevite-wadalite series is classified under VIII/J.11 (Tectosilicates). Typical members of this class are:

Tsaregorodtsevite, VIII/J.11-05, $N(CH_3)_4[Si_2(Si_{0.5}Al_{0.5})O_6]_2$;
Sodalite, VIII/J.11-10, $Na_4Al_3Si_3O_{12}Cl$;
Nosean, VIII/J.11-20, $Na_8Al_6Si_6O_{24}(SO_4)$;
Hauyne, VIII/J.11-30, $(Na,Ca)_{4-8}[Al_6Si_6(O,S)_{24}]\ (SO_4,Cl)_{1-2}$;
Lazurite, VIII/J.11-40, $(Na,Ca)_8(AlSiO_4)_6(S,SO_4,Cl)_{1-2}$;
Tugtupite, VIII/J.11-50, $Na_4AlBeSi_4O_{12}Cl$;
Kamaishilite, VIII/J.11-60, $Ca_2Al_2SiO_6(OH)_2$; and
Bicchulite, VIII/J.11-70, $Ca_2Al_2SiO_6(OH)_2$.

It has now surprisingly been found that such a mineral addition further improves the gliding properties of running surfaces to a remarkable extent. In order to improve the gliding properties of running surfaces, soot, carbon black or graphite can be substituted with these mineral additions. Moreover, due to the color of these minerals, a non-black coloration of running surfaces is easily achievable. The running surfaces according to the invention are inexpensively and easy to produce, are easy to apply and fulfill the demands of durability. Of course, the running surface according to the invention may be used with or without a layer of wax for the purpose of gliding enhancement.

In a preferred embodiment, a running surface according to the invention is made of plastic, especially of polyethylene (PE). Preferentially, ultra high molecular weight (UHMW) polyethylene (PE) e.g. in the range of about $2\times10^6$ g/mol to about $12\times10^6$ g/mol of high density is used for this purpose and processed in a press-sintering process. However, the running surface according to the invention may also be produced by extrusion of high density polyethylene (PE) with a molecular weight in the range of about $2\times10^5$ g/mol to $8\times10^5$ g/mol. Of course, the invention is not limited to the use of a specific polymer matrix and can be carried out with any other preferably hydrophobic plastic material as well, that are useful for the production of such running surfaces.

In an especially preferred embodiment, the mineral addition contains an ultramarine; optionally, further especially mineral additions may be included in the running surface. Ultramarines such as the naturally occuring lazurite (Strunz ID: VIII/J.11-40, the blue component of the gemstone lapis lazuli) are also known under the synonyms cyaneus, lasurite (of Brogger), Lasurstein, lazurite (of Dana), Sapphis (of Agricola). Beside their natural occurrence, ultramarines of the general formula $Na_4[Al_3Si_3O_{12}]S_3$ can be synthesized by fusing kaolin, sodium carbonate and sulfur, rendering them particularly useful for large-scale purposes for cost reasons. With ultramarines, especially advantageous gliding properties are obtainable, in some embodiments even exceeding the effect of soot, carbon black and graphite at comparable or less amounts to be added. Moreover, due to the strong coloration effect of ultramarines, new colorations of running surfaces are obtainable without a negative effect to the gliding properties. Besides a blue coloration (e.g. due to ultramarineblue, C.A.S. no. 57455-37-5), especially pink or violet (C.A.S. no. 12769-96-9) variations of ultramarines are of course also to be used in accordance with the invention in order to achieve more different colorations.

Most preferably, the mineral addition contains about 0.1% to about 40% by weight, preferably about 1% to about 30% by weight of an ultramarine. This range proved especially effective in enhancing the gliding properties without significantly altering stability, flexibility or other mechanical and/or physical properties of the running surface.

In accordance with yet another preferred embodiment of the invention, the running surface additionally contains soot and/or carbon black and/or graphite. Experimental results indicate that both these classes of additives can be synergistically incorporated into a running surface simultaneously, providing an especially advantageous influence on the gliding characteristic of the running surface.

According to an especially preferred embodiment of the invention, the running surface comprises about 75% to about 95% by weight, preferably about 85% by weight of polyethylene, 0% to about 20% by weight, preferably about 10% by weight of soot and/or carbon black and/or graphite and about 0.1% to about 40% by weight, preferably about 1% to about 30% by weight, most preferably about 5% by weight of a mineral addition chosen from the sodalite group and tsaregorodtsevite-wadalite series or a closely related structural and/or chemical analogue thereof, preferably an ultramarine. Compositions comprising these amounts of additives proved especially advantageous with respect to gliding properties, mechanical and handling properties and coloration.

A material composition for the production of a running surface comprises preferably polyethylene and a mineral addition chosen from the sodalite group and tsaregorodtsevite-wadalite series or a closely related structural and/or chemical analogue thereof, preferably an ultramarine. Optionally, soot, carbon black or graphite may be included. A material composition is here and henceforth to be understood including the still unprocessed mixture of crude materials as well as especially a press-sintered body produced from such mixture, from which a running surface can be peeled down.

The use of a mineral chosen from the sodalite group and tsaregorodtsevite-wadalite series or a mixture thereof, especially an ultramarine as additive to a running surface of a winter sports apparatus is especially advantageous.

A running surface according to the invention can be produced in a sintering or extrusion process, comprising the step of adding a mineral addition chosen from the sodalite group and tsaregorodtsevite-wadalite series or a mixture thereof, especially an ultramarine.

The invention will now be exemplarily described by means of preferred embodiments; however, the invention is not to be limited to these embodiments.

DESCRIPTION OF THE PREFERRED EMBODIMENTS

EXAMPLE 1 (FOR COMPARATIVE PURPOSES, STATE OF THE ART)

A mixture of 15 parts by weight of carbon black (20 nm particle size; oil necessity of 500%) and 85 parts by weight of the high density polyethylene Hostalen GUR 4170 (molecular weight 10,5×106 g/mol) is prepared in a mixing apparatus. The mixture is then press-sintered to a homogeneous cylindrical body according to standard procedures (e.g. such as those disclosed in the brochure of Hoechst, "Hostalen GUR" [HKR112-7089C12299/14]). After cooling down, the cylindrical body is peeled down to a band with the thickness of a running surface, e.g. 1.4 mm. The running surface is then roughened on one side and prepared for fixation on the ski body with an oxidizing flame. Of course, the running surface may also be prepared by an extrusion process. The general process of production is not essential to the invention, but rather the nature of the additive(s) to the running surface.

EXAMPLE 2 (ACCORDING TO THE INVENTION)

Example 1 is repeated, but the composition of the starting mixture is altered to 100 parts by weight of the polyethylene component and 1 part by weight of ultramarine (C.A.S. no. 57455-37-5).

EXAMPLE 3 (ACCORDING TO THE INVENTION)

Example 1 is repeated, but the composition of the starting mixture is altered to 85 parts by weight of the polyethylene component, 10 parts by weight of the carbon black component and 5 parts by weight of ultramarine (C.A.S. no. 57455-37-5).

EXAMPLE 4 (ACCORDING TO THE INVENTION)

Example 1 is repeated, but the composition of the starting mixture is altered to 76 parts by weight of the polyethylene component, 4 parts by weight of the carbon black component and 20 parts by weight of ultramarine (C.A.S. no. 57455-37-5).

Measurements, Physical Properties

Running surfaces according to examples 1 to 4 were characterized by means of some of their physical characteristics (table 1). No outstanding differences were detected that might significantly contribute to a change of gliding properties.

TABLE 1 physical characteristics of running surfaces according to examples 1 to 4.

| | Example 1 | Example 2 | Example 3 | Example 4 |
|---|---|---|---|---|
| density [g/cm$^3$] | 1.002 | 0.948 | 1.011 | 1.062 |
| min. melting point [° C.] | 139.7 | 141.0 | 139.3 | 140.0 |
| melting enthalpy [J/g] | 129 | 140 | 129 | 92 |

Gliding Properties

Skis were prepared comprising running surfaces according to examples 1 to 4. For the gliding test purpose, skis were used that are built around a central core, comprising a supporting laminate structure on the top and bottom of the core, the gliding surface being fixed between lateral running edges. However, the running surface according to the invention may of course be used with any type of winter sports apparatus intended for gliding on snow or ice. Beside the different running surfaces, the skis were constructed equivalently. Skis comprising running surfaces according to the invention (examples 2 to 4) exhibited comparable or improved gliding properties in comparison to the ski comprising a running surface according to the prior art (example 1).

What is claimed is:

1. Running surface for a winter sports apparatus, wherein the running surface contains a mineral addition chosen from the group consisting of the sodalite group, the tsaregorodtsevite-wadalite series, and mixtures thereof.

2. Running surface according to claim 1, wherein the running surface is made of or comprises plastic.

3. Running surface according to claim 2, wherein the running surface is made of or comprises polyethylene (PE).

4. Running surface according to claim 1, wherein the mineral addition contains an ultramarine.

5. Running surface according to claim 1, wherein the mineral addition contains about 0.1% to about 40% by weight of an ultramarine.

6. Running surface according to claim 1, wherein the mineral addition contains about 1% to about 30% by weight of an ultramarine.

7. Running surface according to claim 1, wherein the mineral addition contains about 5% by weight of an ultramarine.

8. Running surface according to claim 1, wherein the running surface additionally contains an additive chosen from the group consisting of soot, carbon black, graphite, and mixtures thereof.

9. Running surface according to claim 1, wherein the running surface comprises about 75% to about 95% by weight of polyethylene; 0% to about 20% by weight an additive chosen from the group consisting of soot, carbon black, graphite, and mixtures thereof; and about 0.1% to about 40% by weight of a mineral addition chosen from the group consisting of the sodalite group, the tsaregorodtsevite-wadalite series, and mixtures thereof.

10. Running surface according to claim 1, wherein the running surface comprises about 85% by weight of polyethylene; about 10% by weight an additive chosen from the group consisting of soot, carbon black, graphite, and mixtures thereof; and about 1% to about 30% by weight of a mineral addition chosen from the group consisting of the sodalite group, the tsaregorodtsevite-wadalite series, and mixtures thereof.

11. Winter sports apparatus, comprising a running surface according to claim 1.

12. Material composition for the production of a running surface according to claim 1, comprising polyethylene and a mineral addition chosen from the group consisting of the sodalite group, the tsaregorodtsevite-wadalite series, and mixtures thereof.

13. Material composition according to claim 12, wherein the mineral addition contains an ultramarine.

14. Use of a mineral chosen from the group consisting of the sodalite group, the tsaregorodtsevite-wadalite series, and mixtures thereof, as additive to a running surface of a winter sports apparatus.

15. Use according to claim 14, wherein the mineral addition contains an ultramarine.

16. Method of manufacture of a running surface for a winter sports apparatus in a sintering or extrusion process, comprising the step of adding a mineral addition chosen from the group consisting of the sodalite group, the tsaregorodtsevite-wadalite series, and mixtures thereof.

17. Method according to claim 16, wherein the mineral addition contains an ultramarine.

* * * * *